US007511413B2

(12) United States Patent
Lee et al.

(10) Patent No.: US 7,511,413 B2
(45) Date of Patent: Mar. 31, 2009

(54) ELECTRON EMISSION DEVICE HAVING A GRID ELECTRODE WITH A PLURALITY OF ELECTRON BEAM-GUIDE HOLES

(75) Inventors: Byong-Gon Lee, Suwon-si (KR); Sang-Ho Jeon, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 469 days.

(21) Appl. No.: 11/291,256

(22) Filed: Nov. 30, 2005

(65) Prior Publication Data

US 2006/0113917 A1 Jun. 1, 2006

(30) Foreign Application Priority Data

Nov. 30, 2004 (KR) ..... 10-2004-0099557

(51) Int. Cl.
*H01J 19/38* (2006.01)
*H01J 19/24* (2006.01)
*H01J 1/62* (2006.01)

(52) U.S. Cl. ..... 313/496; 313/495

(58) Field of Classification Search ..... 313/495–497, 313/309–311

See application file for complete search history.

(56) References Cited

U.S. PATENT DOCUMENTS

2003/0214226 A1* 11/2003 Lee et al. ..... 313/495
2004/0135490 A1* 7/2004 Lee et al. ..... 313/495
2004/0222734 A1* 11/2004 Oh ..... 313/497

* cited by examiner

*Primary Examiner*—Karabi Guharay
(74) *Attorney, Agent, or Firm*—Christie, Parker & Hale, LLP

(57) ABSTRACT

An electron emission device is provided including a first substrate and a second substrate facing each other and separated from each other by a predetermined distance. An electron emission unit is disposed on the first substrate, and a light emission unit is disposed on a surface of the second substrate facing the first substrate. A grid electrode is disposed between the first substrate and the second substrate, and has a hole region with a plurality of electron beam-guide holes and a no-hole region surrounding the hole region. The first substrate has a first active area and a first outer portion. The second substrate has a second active area and a second outer portion. The grid electrode has a larger area than the first active area and the second active area, and the no-hole region is disposed corresponding to the first outer portion.

15 Claims, 8 Drawing Sheets

ELECTRON EMISSION DEVICE HAVING A GRID ELECTRODE WITH A PLURALITY OF ELECTRON BEAM-GUIDE HOLES

CROSS REFERENCE TO RELATED APPLICATION

This application claims priority to and the benefit of Korean Patent Application No. 10-2004-0099557 filed on Nov. 30, 2004 in the Korean Intellectual Property Office, the entire content of which is incorporated herein by reference.

BACKGROUND OF THE INVENTION

1. Field of the Invention

The present invention relates to an electron emission device, and more particularly, to an electron emission device having a grid electrode inside a vacuum vessel to reduce damage by arc discharge.

2. Description of the Related Art

Generally, electron emission devices are classified into those using hot cathodes as the electron emission source, and those using cold cathodes as the electron emission source.

There are several types of cold cathode electron emission devices, including a field emitter array (FEA) type, a surface conduction emission (SCE) type, a metal-insulator-metal (MIM) type, and a metal-insulator-semiconductor (MIS) type.

The MIM-type and the MIS-type electron emission devices have electron emission regions with a metal/insulator/metal (MIM) structure and a metal/insulator/semiconductor (MIS) structure, respectively. When voltages are applied to the two metals or the metal and the semiconductor respective sides of the insulator, electrons supplied by the metal or semiconductor on the lower side pass through the insulator due to the tunneling effect and arrive on the metal on the upper side. Of the electrons that arrive at the metal on the upper side, those that have energy greater than or equal to the work function of the metal on the upper side are emitted from the upper electrode.

The SCE-type electron emission device includes a thin conductive film formed between first and second electrodes arranged facing each other on a substrate. Micro-crack electron emission regions are positioned on the thin conductive film. When voltages are applied to the first and second electrodes and an electric current is applied to the surface of the conductive film, electrons are emitted from the electron emission regions.

The FEA-type electron emission device uses electron emission regions made from materials having low work functions or high aspect ratios. When exposed to an electric field in a vacuum atmosphere, electrons are easily emitted from these electron emission regions. A front sharp-pointed tip structure based on molybdenum Mo or silicon Si, or a carbonaceous material such as carbon nanotube, graphite and diamond-like carbon, has been developed to be used as the electron emission regions.

Although the above electron emission devices are different in their detailed structures according to the type, they commonly include first and second substrates facing each other. Electron emission regions and driving electrodes are positioned on the first substrate, and an anode electrode and a phosphor layer are positioned on the second substrate, where the first and second substrates form a vacuum vessel. The anode electrode facilitates accelerating the electrons emitted from the first substrate toward the phosphor layer.

The electron emission devices apply the driving voltages to the driving electrodes to emit the electrons from the electron emission regions in each pixel, and the electrons are attracted by the high voltage applied to the anode electrode ((+) voltages ranging from several hundred to several thousand volts) and directed toward the second substrate to collide against the corresponding phosphor layer, thereby performing a predetermined light emission or image display.

The electron emission device performing the above action can secure the stable driving characteristics so long as the vacuumed inner space maintains the electrically stable status with respect to the high anode voltage.

However, in the conventional electron emission devices, since the edge of an active area formed on the first substrate—an area where the electron emission regions and the driving electrodes are formed and the electron emission occurs—faces the anode electrode, the devices can be directly influenced by the anode voltage. The edge of the active area is a region where the continuity of the structures is broken in terms of a plan view of the structures provided on the first substrate.

Due to the above structural characteristics, a stronger electric field can be applied to the edge of the active area than to the center of the active area, or distortion of the electric field can occur. At the worst, there is a problem that causes the abnormal discharge, such as arcing in the edge of the active area, to damage the structures formed on the first substrate.

Further, as the brightness of the screen is proportional to the anode voltage, the anode voltage has been increased accordingly. However, as the anode voltage becomes higher, the possibility of generating abnormal discharge like arcing inside the vacuum vessel is increased.

SUMMARY OF THE INVENTION

In one exemplary embodiment of the present invention, there is provided an electron emission device which inhibits abnormal discharge like arcing occurring in the edge of the active area to prevent damage of internal structures, and which also allows high voltage to be applied to the anode electrode.

In one embodiment of the present invention, the electron emission device includes a first substrate and a second substrate facing each other and separated from each other by a predetermined distance. An electron emission unit is disposed on the first substrate, and a light emission unit is disposed on a surface of the second substrate facing the first substrate. A grid electrode is disposed between the first substrate and the second substrate and has a hole region with a plurality of electron beam-guide holes and a no-hole region surrounding the hole region. The first substrate has a first active area and a first outer portion. The second substrate has a second active area and a second outer portion. The grid electrode spans a larger area than the first active area and the second active area, and the no-hole region is disposed corresponding to the first outer portion.

The no-hole region of the grid electrode can be disposed corresponding to the second outer portion.

The first active area, the second active area and the hole region of the grid electrode can span the same area. The first active area can span a larger area than the second active area and the hole region of the grid electrode.

In another exemplary embodiment of the present invention, an electron emission device includes a first substrate and a second substrate facing each other and separated from each other by a predetermined distance. A plurality of cathode electrodes and a plurality of gate electrodes are disposed on the first substrate and are insulated from each other. A plurality of electron emission regions are electrically connected to the cathode electrodes, and a phosphor layer is on a surface of the second substrate facing the first substrate. An anode electrode is disposed on a surface of the phosphor layer, and a grid electrode is disposed between the first substrate and the second substrate. The grid electrode has a hole region with a plurality of electron beam-guide holes and a no-hole region surrounding the hole region. The first substrate has a first active area and a first outer portion. The second substrate has a second active area and a second outer portion. The grid electrode spans a larger area than the first active area and the second active area, and the no-hole region is disposed corresponding to the first outer portion.

The cathode electrodes and the gate electrodes can form pixel regions within the first active area, and the electron emission regions can be disposed contacting the cathode electrodes in each of the pixel regions.

The electron emission device can further include a plurality of gate dummy electrodes and a plurality of cathode dummy electrodes disposed in an outermost portion of the first active area within the first active area.

The grid electrode according to one embodiment meets the following formula:

$$W \geq \mathrm{Max}\left\{\mathrm{d_am} \times \frac{Va - Vm}{1400\ \mathrm{V}},\ \mathrm{d_mc} \times \frac{Vm - \min(Vc)}{50\ \mathrm{V}}\right\}$$

where W is the width of the no-hole region, d_am is the distance between the anode electrode and the grid electrode, d_mc is the distance between the grid electrode and the cathode electrode, Va is the anode voltage, Vm is the grid voltage, and Vc is the cathode voltage.

In another embodiment, a grid electrode for an electron emission device is to be disposed between a first substrate, with a first active area and a first outer portion, and a second substrate, with a second active area and a second outer portion. The grid electrode includes a hole region, with a plurality of electron beam-guide holes, and a no-hole region surrounding the hole region. The grid electrode spans a larger area than the first active area and the second active area. The no-hole region may also substantially correspond to the size and the shape of the first outer portion.

BRIEF DESCRIPTION OF THE DRAWINGS

The above and other features of various embodiments of the present invention will be better understood by reference to the following detailed description when considered in conjunction with the accompanying drawings wherein.

DETAILED DESCRIPTION

The present invention will be described more fully hereinafter with reference to the accompanying drawings, in which examples of embodiments of the invention are shown.

Figure 1:
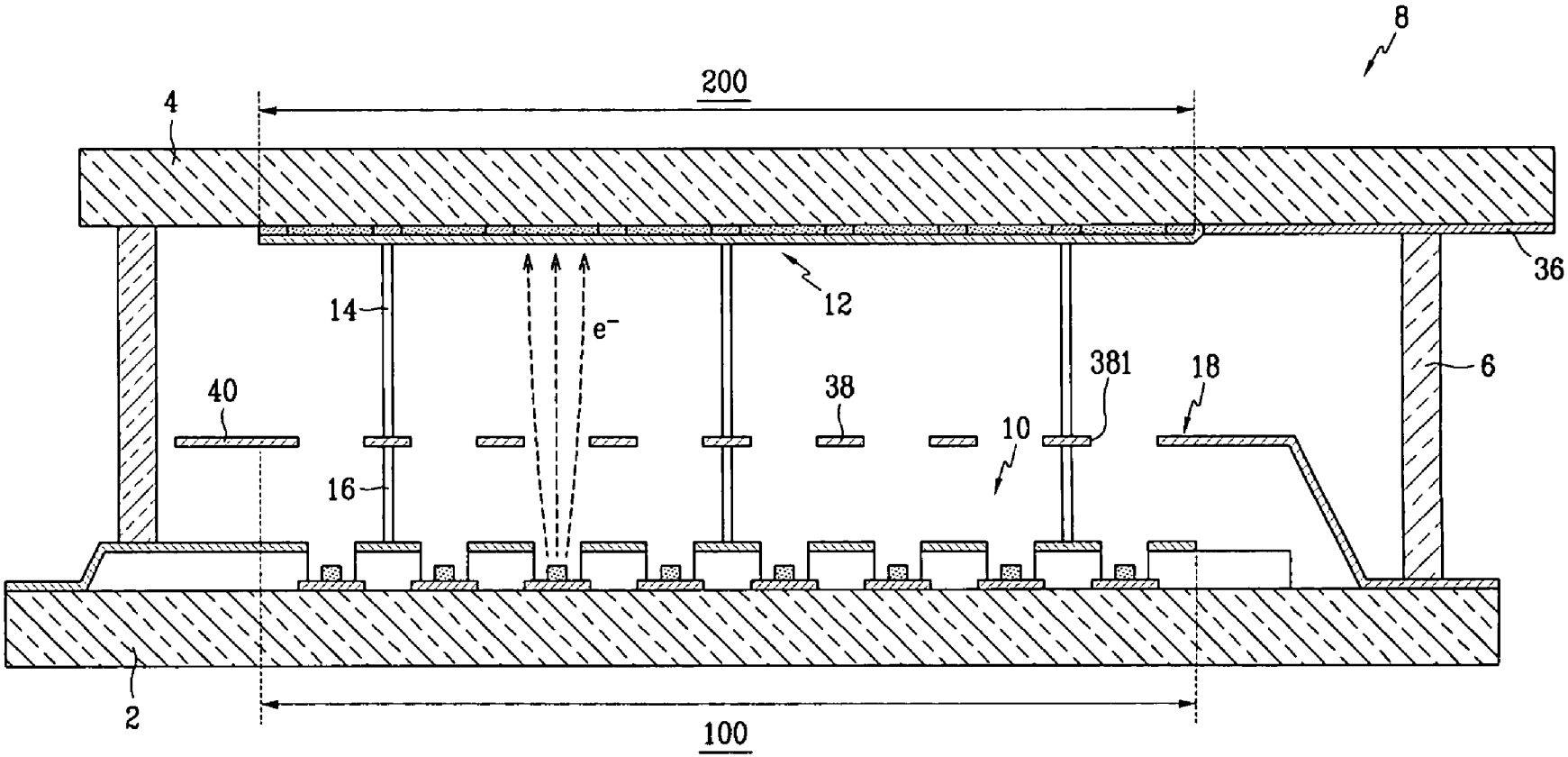
FIG. 1 is a cross-sectional view of an electron emission device according to one embodiment of the present invention.

With reference to FIG. 1, an electron emission device includes a first substrate 2 and a second substrate 4 parallel to and facing each other. The substrates 2 and 4 are separated from each other by a predetermined distance. Side barrier ribs 6 are disposed in the edges of the first substrate 2 and the second substrate 4 to form a closed inner space together with the first substrate 2 and the second substrate 4. Accordingly, the first substrate 2, the second substrate 4, and the side barrier ribs 6 form a vacuum vessel 8.

An electron emission unit 10 is disposed on a surface of the first substrate 2 facing the second substrate 4 to emit electrons toward the second substrate 4, and a light emission unit 12 is disposed on a surface of the second substrate 4 facing the first substrate 2 to emit visible light by the electrons to perform predetermined light emission or image display. In addition, a grid electrode 18 is disposed between the first substrate 2 and the second substrate 4 maintaining a predetermined distance from both of the substrates with a top and bottom spacers 14 and 16.

FIG. 1 shows, as an example, an electron emission unit applied to a field emitter array (FEA) type electron emission device. In the following, the structures of the electron emission unit and the light emission unit of the FEA type electron emission device will be described as an example.

Figure 2:
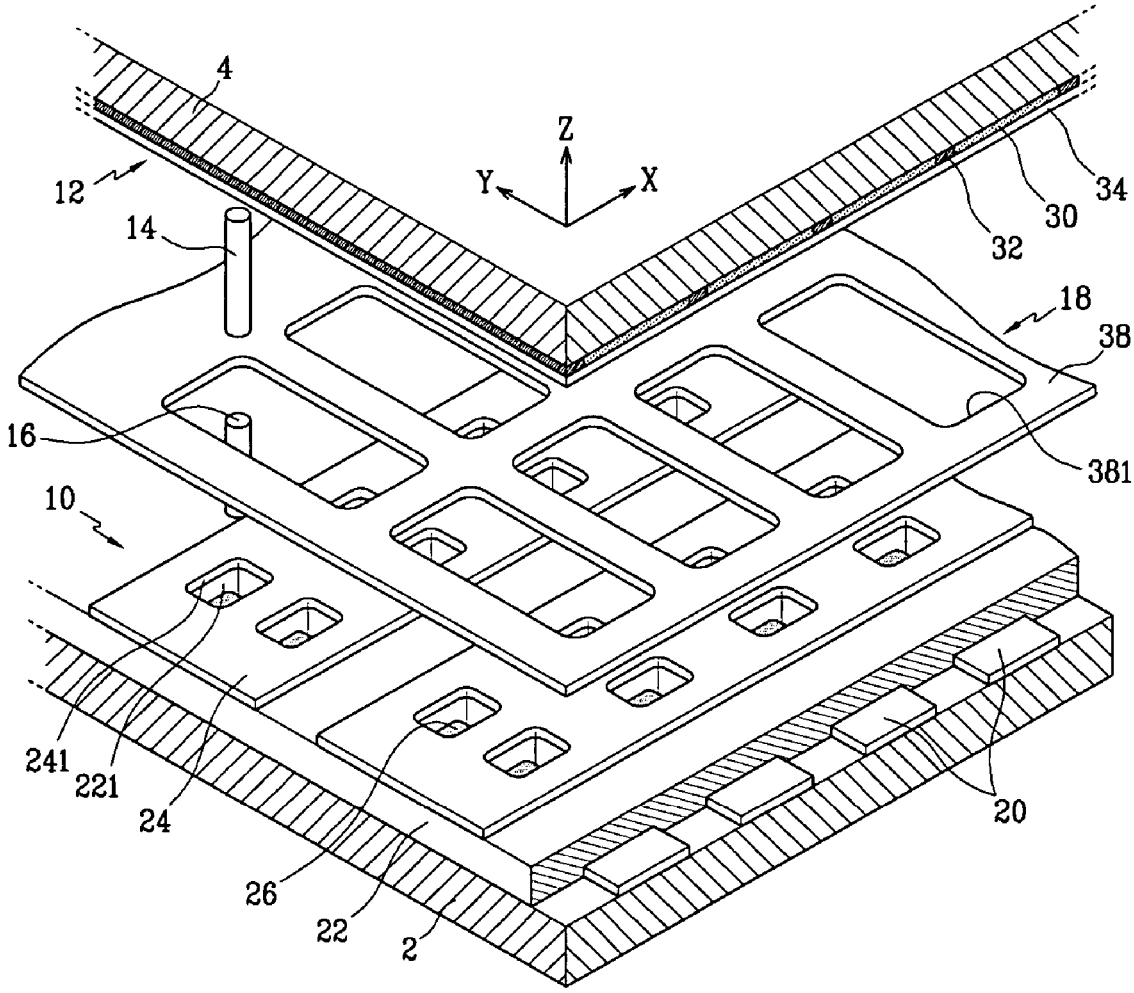
FIG. 2 is a partial exploded perspective view of the electron emission device according to one embodiment of the present invention.
Figure 3:
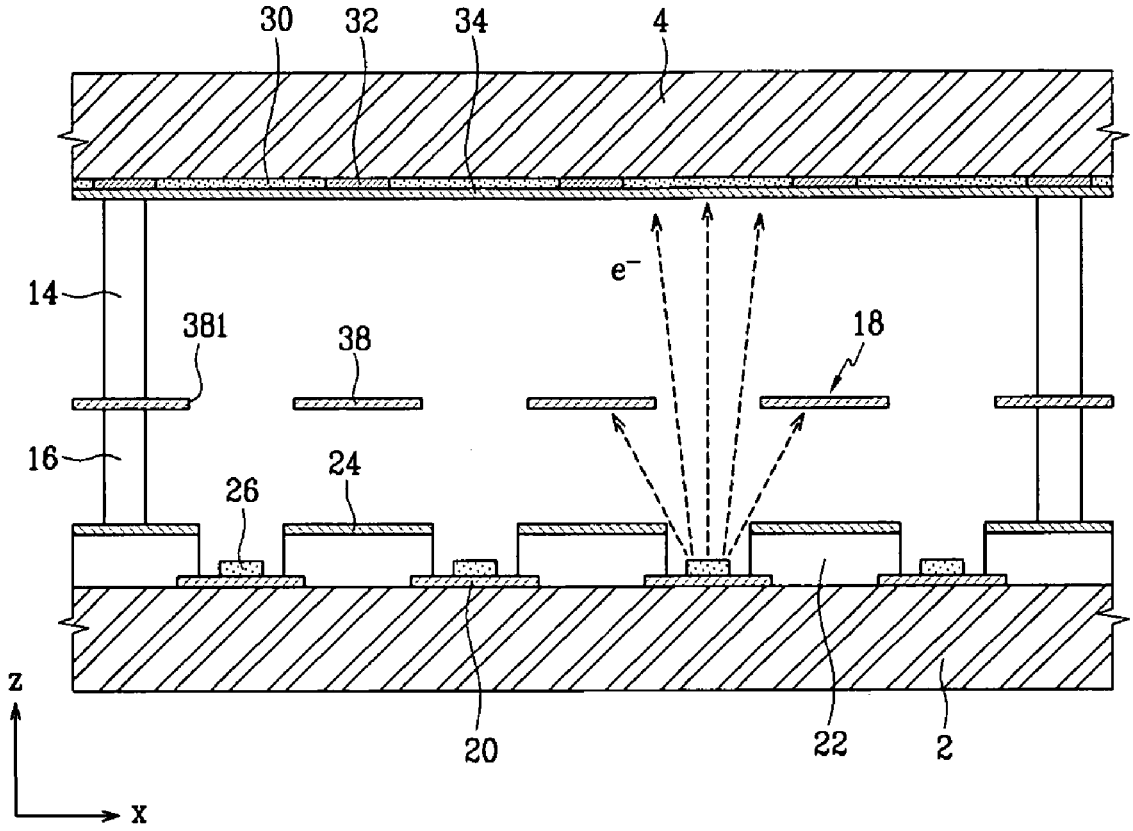
FIG. 3 is a partial cross-sectional view of the electron emission device according to one embodiment of the present invention.

Referring to FIG. 2 and FIG. 3, cathode electrodes 20 are disposed on the first substrate 2 in a stripe pattern along one direction (Y direction in FIG. 2) and an insulating layer 22 is disposed on substantially the entire first substrate 2 and covers the cathode electrodes 20. On the insulating layer 22, gate electrodes 24 are disposed in a stripe pattern along a direction perpendicular to the cathode electrodes 20 (direction X in FIGS. 2 and 3).

A pixel region to be defined as where the cathode electrode 20 and the gate electrode 24 cross each other. The openings 241 and 221 are formed in the gate electrode 24 and the insulating layer 22 in each of the pixel regions to expose a part of the surface of the cathode electrode 20, and an electron emission region 26 is formed on the cathode electrode 20 inside the openings 241 and 221.

The electron emission region 26 includes material that emits electrons when an electric field is applied under a vacuum atmosphere, for example, a carbonaceous material or a nanometer-sized material. The electron emission region 26 may include a material selected from the group consisting of carbon nanotube, graphite, graphite nanofiber, diamond, diamond-like carbon, $C_{60}$, silicon nanowire, or any suitable combinations thereof. The electron emission region 26 may be fabricated by, for example, screen printing, direct growth, chemical vapor deposition, or sputtering.

Figure 4:
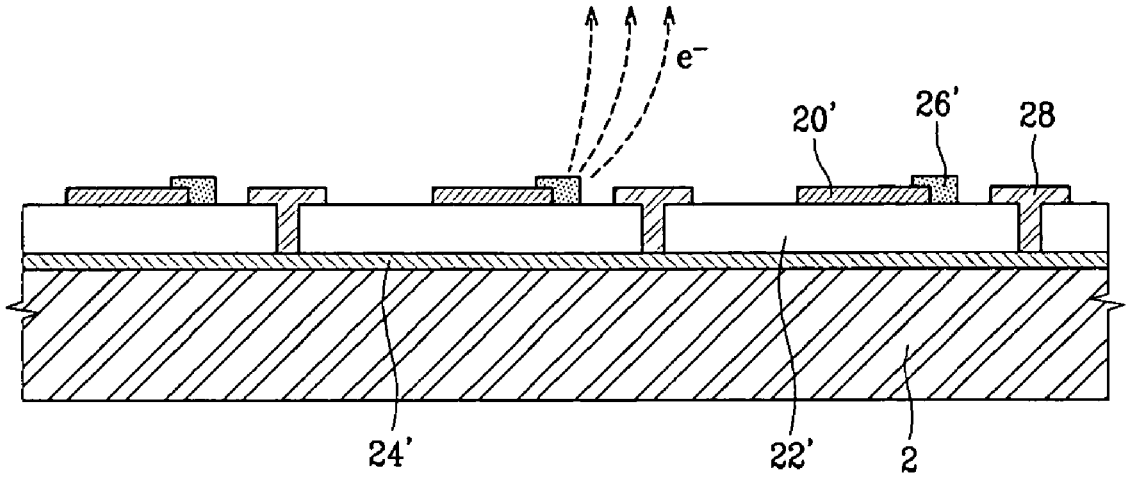
FIG. 4 is a partial enlarged cross-sectional view of a modified electron emission unit of the electron emission device according to one embodiment of the present invention.

As shown in FIG. 4, cathode electrodes 20' and gate electrodes 24' can be transposed in position. That is, the gate electrodes 24' may be first disposed on the first substrate 2, and then the cathode electrodes 20' may be formed on an insulating layer 22'.

In this case, an electron emission region 26' may be disposed on the insulating layer 22' and may contact the side of the cathode electrode 20', and counter electrodes 28 electrically connected to the gate electrodes 24' are disposed between the cathode electrodes 20' and spaced apart from the electron emission regions 26'. The counter electrode 28 has a role to play in forming a strong electric field around the electron emission region 26' by raising the electric field of the gate electrode 24' over the insulating layer 22'.

With reference again to FIG. 2 and FIG. 3, a phosphor layer 30 and a black layer 32 are disposed on a surface of the second substrate 4 facing the first substrate 2, and an anode electrode 34, that includes a metallic layer such as aluminum, is formed on the phosphor layer 30 and the black layer 32. The anode electrode 34 receives a voltage necessary for accelerating an electron beam through an anode lead wire 36 (FIG. 1), and it has a role to play in reflecting the visible light emitted to the first substrate 2 among the visible lights emitted from the phosphor layer 30 toward the second substrate 4 to thereby increase screen brightness.

Figure 5:
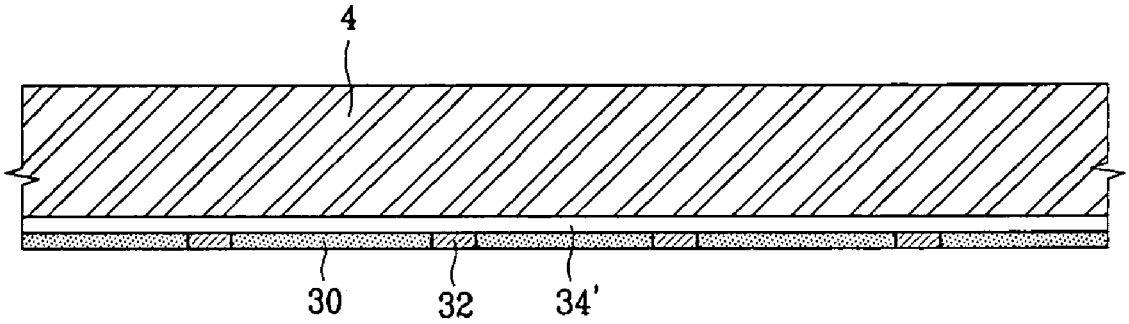
FIG. 5 is a partial enlarged cross-sectional view of a modified light emission unit of the electron emission device according to one embodiment of the present invention.

As shown in FIG. 5, an anode electrode 34' may be first disposed on a surface of the second substrate 4, and the phosphor layer 30 and the black layer 32 may be formed on the anode electrode 34'. The anode electrode 34' may include a transparent conductive layer, such as indium tin oxide (ITO) to transmit visible light emitted from the phosphor layer 30.

Figure 6:
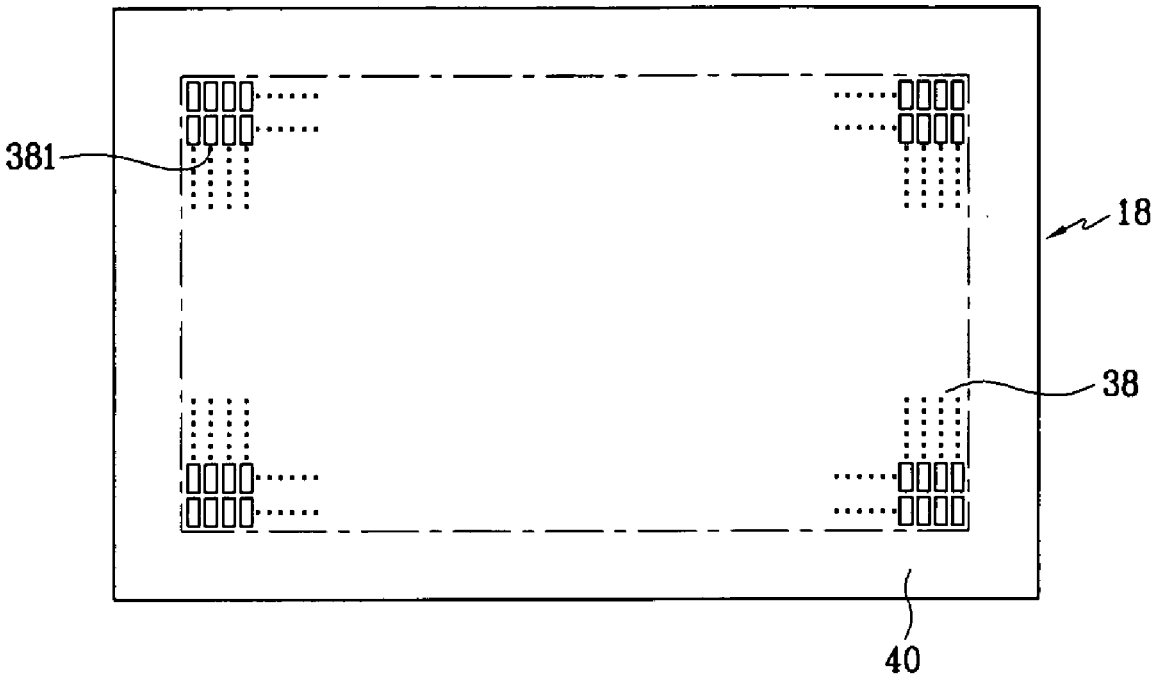
FIG. 6 is a plan view of a grid electrode of the electron emission device according to one embodiment of the present invention.

Referring back to FIG. 2 and FIG. 3, a grid electrode 18 having a plate shape is disposed between the first substrate 2 and the second substrate 4. The grid electrode 18 has a plurality of electron beam-guide holes 381. As shown in FIG. 6, the grid electrode 18 has a hole region 38 with a plurality of the electron beam-guide holes 381 and a no-hole region 40 surrounding the hole region 38, and each of the electron beam-guide holes 381 of the hole region 38 can be arranged to correspond to a corresponding pixel region formed on the first substrate 2.

The electron emission device with the above structure provides predetermined voltages to the cathode electrodes 20 that are driven by the gate electrodes 24, the grid electrode 18 and the anode electrode 34.

First, a scan signal voltage is applied to the cathode electrodes 20 or the gate electrodes 24, and a data signal voltage with the voltage difference of several to tens of volts from the scan signal voltage is applied to the other electrodes. Positive (+) voltage of several hundreds to several thousands of volts is applied to the anode electrode 34, and a medium level voltage is applied to the grid electrode 18. The medium level voltage is higher than the scan signal voltage and the data signal voltage and lower than the anode voltage, for example, positive (+) voltage of several tens of volts.

As shown in FIG. 3, an electric field is formed around the electron emission region 26 in the pixels where the voltage difference between the cathode electrode 20 and the gate electrode 24 is over the critical value, and electrons are emitted therefrom. The emitted electrons are then attracted by the high voltage applied to the anode electrode 34, migrate toward the second substrate 4, and collide against the corresponding phosphor layer 30, thereby emitting light.

During this process, the grid electrode 18 intercepts electrons among the electrons emitted from one pixel which spread toward the phosphor layer of the adjacent pixel to prevent the crosstalk, and it also enables the electron emission unit 10 to have an electrically stable status with respect to the high anode voltage, thereby preventing abnormal discharges.

In addition, in the present embodiment, the grid electrode 18 has the following relationship with a first active area 100 (FIG. 1) formed on the first substrate 2 and a second active area 200 (FIG. 1) formed on the second substrate 4.

Figure 7A:
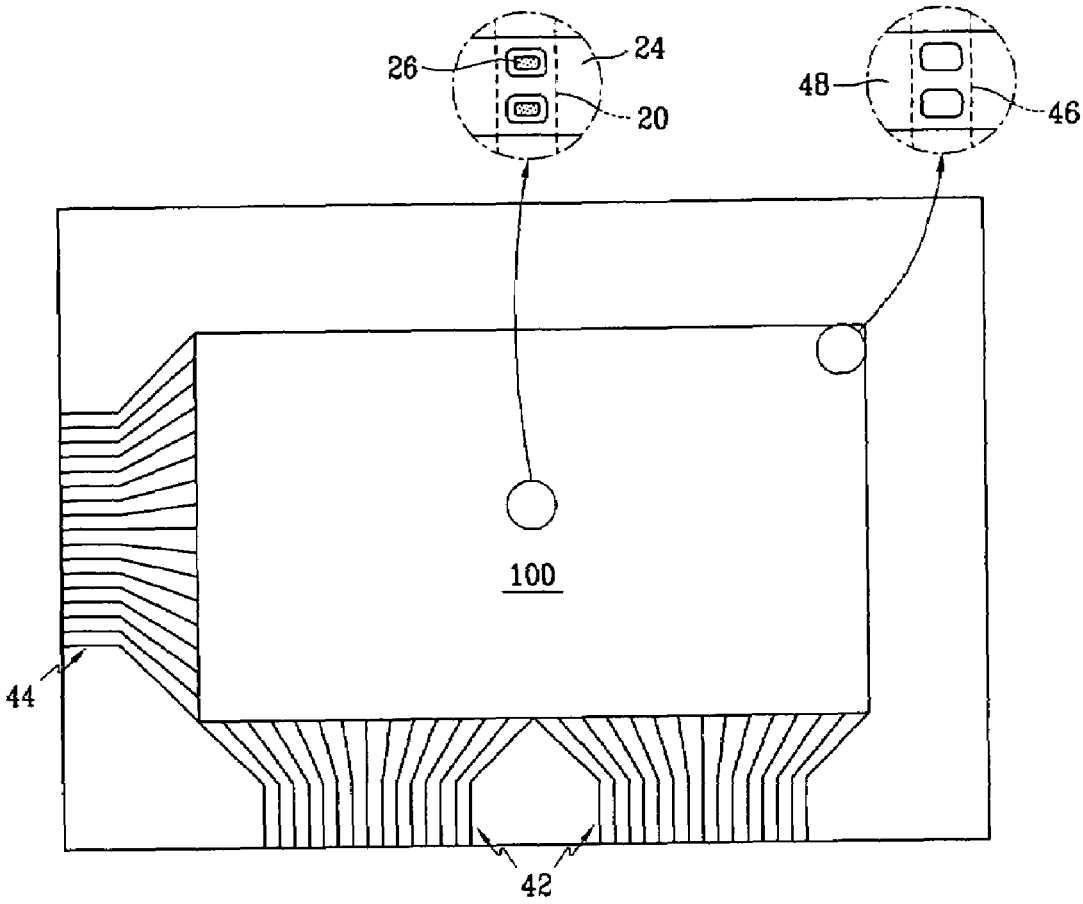
FIG. 7*a* is a plan view of a first substrate of the electron emission device according to one embodiment of the present invention.
Figure 7B:
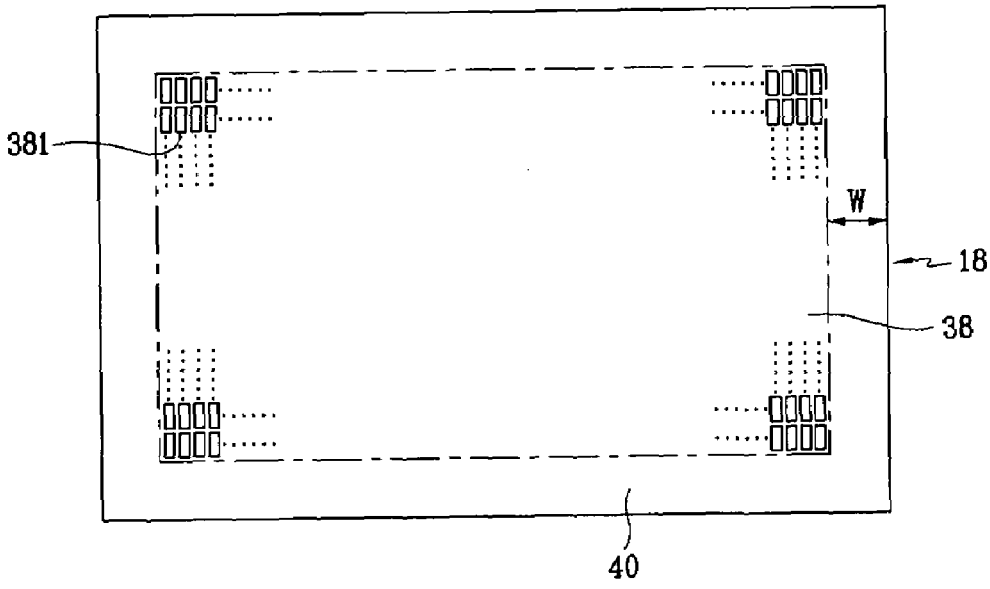
FIG. 7*b* is a plan view of a grid electrode spaced from the first substrate of FIG. 7*a;*
Figure 8A:
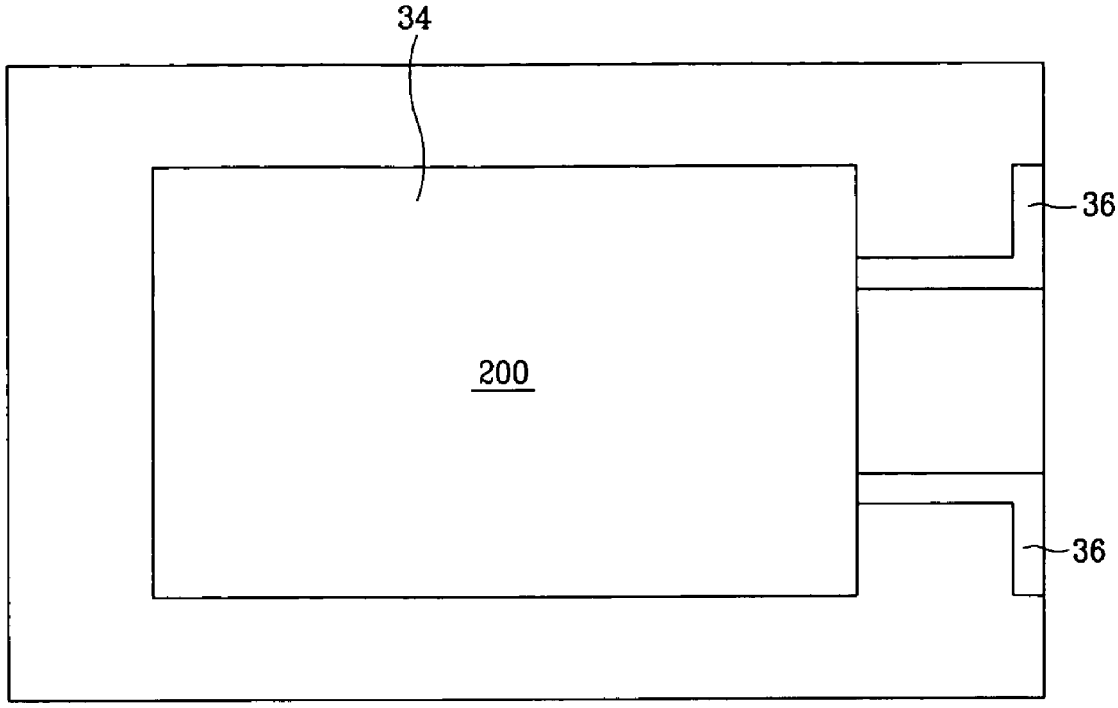
FIG. 8*a* is a plan view of a second substrate of the electron emission device according to one embodiment of the present invention.
Figure 8B:
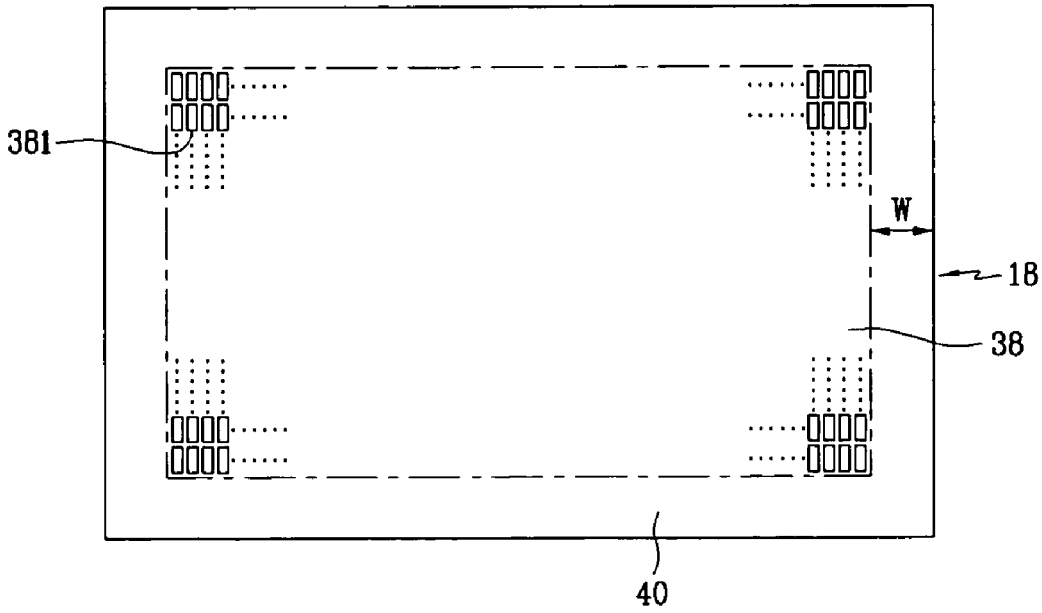
FIG. 8*b* is a plan view of the grid electrode spaced from the second substrate of FIG. 8*a*.

With reference to FIGS. 7*a* and 7*b*, the first active area 100 of the present embodiment is defined as where the cathode electrodes 20 and the gate electrodes 22 cross each other, i.e., the area including the pixel region. Cathode lead wires 42 are extended from the cathode electrodes 20, and the gate lead wires 44 are extended from the gate electrodes 24.

Cathode dummy electrodes 46 can be disposed in the outermost portions of the cathode electrodes 20, and gate dummy electrodes 48 can be disposed in the outermost portions of the gate electrodes 24. The first active area 100 is defined as the area which includes the cathode dummy electrodes 46 and the gate dummy electrodes 48.

The cathode dummy electrodes 46 and the gate dummy electrodes 48 are electrodes which do not contribute to electron emission although they receive the driving voltage in the same way as other electrodes. They are disposed at a position where the driving voltage is unstably applied, the outermost portions of the electrodes, to play a role in stabilizing the driving characteristics of the electron emission device. The electron emission regions 26 are not provided to the cathode dummy electrodes 46 and the portions of the cathode electrodes 20 which the gate dummy electrodes 48 cross.

Referring to FIGS. 7*a* through 8*b*, in the present embodiment, the second active area 200 is the area which emits visible light from the phosphor layer to actually contribute light emission and image display, and is defined to be where the anode electrode 34 is positioned. The first active area 100 can be formed to have the same area as the second active area 200.

When the first active area 100 and the second active area 200 are defined as above, the grid electrode 18 has a larger area than the first active area 100 and the second active area 200, and in addition, the no-hole region 40 is disposed corresponding to the outer portions of the first active area 100 and the second active area 200 with respect to the first substrate 2 and the second substrate 4. Then, the hole region 38 of the grid electrode 18 can be formed to have the same area as the first active area 100 and the second active area 200.

Since the no-hole region 40 of the grid electrode 18 is disposed in the edge of the two active areas as mentioned above, the edge of the first active area 100 faces the no-hole region 40 of the grid electrode 18 and lies outside the region directly facing the light emission unit 12 (FIG. 1). Since the no-hole region 40 is a region where electron beam-guide holes 381 are not formed, it limits the influence of the high anode voltage on the electron emission unit 10, and electrically stabilizes the edge of the first active area 100.

Accordingly, the electron emission device of the present embodiment can prevent generating abnormal electric field or distorting electric field at the edge of the first active area 100, and it allows the high voltage to be applied to the anode electrode 34, thereby achieving high brightness.

The width (W) of the no-hole region 40 of the grid electrode 18 meets the following formula according to the distance between the grid electrode 18 and the anode electrode 34, the distance between the grid electrode 18 and the cathode electrode 20, and the voltage condition applied to each electrode:

$$W \geq \mathrm{Max}\left\{\mathrm{d_am} \times \frac{Va - Vm}{1400\ \mathrm{V}}, \mathrm{d_mc} \times \frac{Vm - \min(Vc)}{50\ \mathrm{V}}\right\}$$

where d_am is the distance between the anode electrode 34 and the grid electrode 18, d_mc is the distance between the grid electrode 18 and the cathode electrode 20, and Va, Vm, and Vc are the anode voltage, the grid voltage, and the cathode voltage, respectively, and are measured in volts (V).

The above formula sets a minimum width with which the no-hole region 40 can perform its function, and the width of the no-hole region 40 is proportional to the distance between the anode electrode 34 and the grid electrode 18 and the voltage difference between the anode voltage and the grid voltage. The width is also proportional to the distance between the grid electrode 18 and the cathode electrode 20 and the voltage difference between the grid voltage and the minimum cathode voltage.

Figure 9:
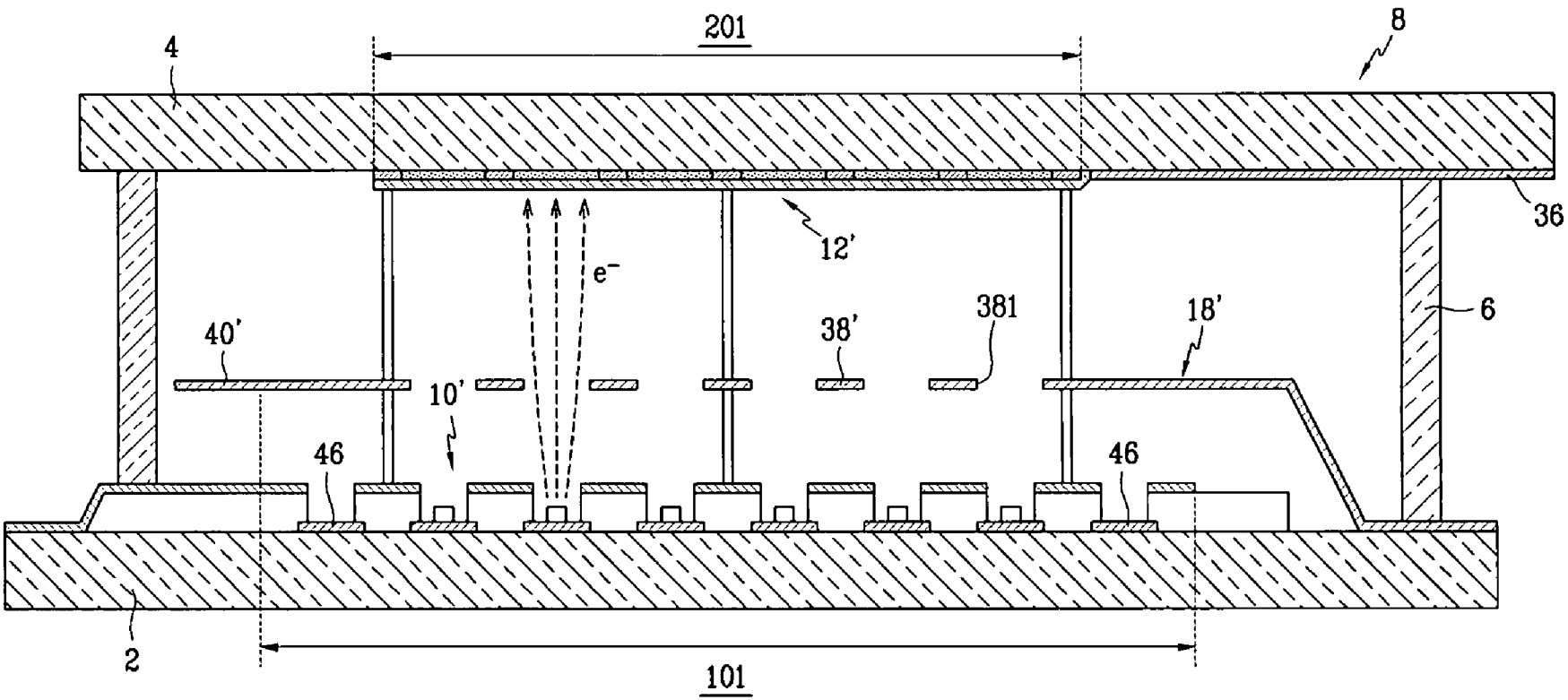
FIG. 9 is a cross-sectional view of an electron emission device according to another embodiment of the present invention.

As shown in FIG. 9, in another embodiment of the present invention, a first active area 101 is formed to have a larger area than a second active area 201, and a hole region 38' of a grid electrode 18' is formed to have the same area as the second active area 201 so that a no-hole region 40' of the grid electrode 18' is arranged along the first substrate 2 to overlap the edge of the first active area 101.

In the above structure, the no-hole region 40' can protect the edge of the first active area 101 more effectively from the influence of the high anode voltage. The cathode dummy electrodes 46 and the gate dummy electrodes 48 can be positioned in the edge of the first active area 101 overlapped by the no-hole region 40'.

In the above, the electron emission device of a field emitter array (FEA) type has been described which emits electrons by use of an electric field, but the electron emission device of the present invention is not limited to the above and can be applied to various forms other than the FEA type electron emission device, such as a surface conduction emitter (SCE) type, a metal-insulator-metal (MIM) type, and a metal-insulator-semiconductor (MIS) type electron emission devices.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electron emission device comprising:

a first substrate and a second substrate facing each other and separated from each other by a predetermined distance;

an electron emission unit on the first substrate;

a light emission unit on a surface of the second substrate facing the first substrate; and a grid electrode between the first substrate and the second substrate, the grid electrode having a hole region with a plurality of electron beam-guide holes and a no-hole region surrounding the hole region, wherein the first substrate has a first active area and a first outer portion, wherein the second substrate has a second active area and a second outer portion, and wherein the grid electrode spans a larger area than the first active area and the second active area, and the no-hole region corresponds to the first outer portion, wherein the electron emission unit includes an electron emission region and a cathode electrode electrically connected to the electron emission region, and the light emission unit includes a phosphor layer and an anode electrode formed on a surface of the phosphor layer, and the grid electrode meets the following formula:

$$W \geq \mathrm{Max}\left\{\mathrm{d_am} \times \frac{Va - Vm}{1400\ \mathrm{V}}, \mathrm{d_mc} \times \frac{Vm - \min(Vc)}{50\ \mathrm{V}}\right\}$$

where W is a width of the no-hole region d_am is a distance between the anode electrode and the grid electrode, d_mc is a distance between the grid electrode and the cathode electrode, Va is an anode voltage, Vm is a grid voltage, and Vc is a cathode voltage.

2. The electron emission device of claim 1, wherein the no-hole region of the grid electrode is disposed corresponding to the second outer portion.

3. The electron emission device of claim 2, wherein the first active area, the second active area and the hole region of the grid electrode span the same area.

4. The electron emission device of claim 2, wherein the first active area spans a larger area than the second active area and the hole region of the grid electrode.

5. An electron emission device comprising:

a first substrate and a second substrate facing each other and separated from each other by a predetermined distance;

a plurality of cathode electrodes and a plurality of gate electrodes on the first substrate and insulated from each other;

a plurality of electron emission regions electrically connected to the cathode electrodes;

a phosphor layer on a surface of the second substrate facing the first substrate;

an anode electrode on a surface of the phosphor layer; and a grid electrode between the first substrate and the second substrate, the grid electrode having a hole region with a plurality of electron beam-guide holes and a no-hole region surrounding the hole region, wherein the first substrate has a first active area and a first outer portion, wherein the second substrate has a second active area and a second outer portion, and wherein the grid electrode spans a larger area than the first active area and the second active area, and the no-hole region corresponds to the first outer portion, wherein the grid electrode meets the following formula:

$$W \geq \mathrm{Max}\left\{\mathrm{d_am} \times \frac{Va - Vm}{1400\ \mathrm{V}}, \mathrm{d_mc} \times \frac{Vm - \min(Vc)}{50\ \mathrm{V}}\right\}$$

where W is a width of the no-hole region, d_am is a distance between the anode electrode and the grid electrode d_mc is a distance between the grid electrode and the cathode electrode, Va is an anode voltage, Vm is a grid voltage, and Vc is a cathode voltage.

6. The electron emission device of claim 5, wherein the cathode electrodes and the gate electrodes form pixel regions within the first active area, and the electron emission regions are disposed contacting the cathode electrodes in each of the pixel regions.

7. The electron emission device of claim 6, further comprising a plurality of gate dummy electrodes and a plurality of cathode dummy electrodes disposed in an outermost portion of the first active area within the first active area.

8. The electron emission device of claim 5, wherein the no-hole region of the grid electrode is disposed corresponding to the second outer portion.

9. The electron emission device of claim 8, wherein the first active area, the second active area and the hole region of the grid electrode span the same area.

10. The electron emission device of claim 8, wherein the first active area spans a larger area than the second active area and the hole region of the grid electrode.

11. The electron emission device of claim 5, wherein the electron emission region includes at least one material selected from the group consisting of carbon nanotube, graphite, graphite nanofiber, diamond, diamond-like carbon, $C_{60}$, silicon nanowire and combinations thereof.

12. A arid electrode for an electron emission device, the arid electrode between a first substrate with a first active area and a first outer portion, and a second substrate with a second active area and a second outer portion, the grid electrode comprising:

a hole region with a plurality of electron beam-guide holes; and a no-hole region surrounding the hole region, wherein the grid electrode spans a larger area than said first active area and said second active area, and wherein the no-hole region substantially corresponds to a size and a shape of said first outer portion, wherein a width of the no-hole region is greater than or equal to both of the following formulae:

$$d_am \times (Va - Vm)/1400V; \text{ and}$$

$$d_mc \times (Vm - \min(Vc))/50V,$$

where the grid electrode is at a distance d_am from an anode electrode driven at a voltage Va, and a distance d_mc from a cathode electrode driven at a voltage Vc, and wherein the grid electrode is driven at a voltage Vm.

13. The grid electrode of claim 12, wherein the no-hole region substantially corresponds to a size and a shape of said second outer portion.

14. The grid electrode of claim 13, wherein the hole region spans substantially the same area as said first active area and said second active area.

15. The grid electrode of claim 13, wherein the hole region spans a smaller area than said first active area.

* * * * *

UNITED STATES PATENT AND TRADEMARK OFFICE

CERTIFICATE OF CORRECTION

PATENT NO. : 7,511,413 B2
APPLICATION NO. : 11/291256
DATED : March 31, 2009
INVENTOR(S) : Byong-Gon Lee et al.

It is certified that error appears in the above-identified patent and that said Letters Patent is hereby corrected as shown below:

| | |
|---|---|
| Column 8, Claim 1, line 11 | After "region" Insert -- , -- |
| Column 8, Claim 5, line 52 | After "trode" Insert -- , -- |
| Column 9, Claim 12, line 22 and 23 | Delete "arid" Insert -- grid -- |

Signed and Sealed this
Seventh Day of June, 2011

David J. Kappos

David J. Kappos
*Director of the United States Patent and Trademark Office*